United States Patent [19]

Evans

[11] 4,305,117

[45] Dec. 8, 1981

[54] ARTIFICIAL ILLUMINATION OF ORNAMENTAL WATER FOUNTAINS WITH COLOR BLENDING IN RESPONSE TO MUSICAL TONE VARIATIONS

[75] Inventor: Stanley H. Evans, Canyon Country, Calif.

[73] Assignee: Rain Jet Corporation, Burbank, Calif.

[21] Appl. No.: 130,982

[22] Filed: Mar. 17, 1980

[51] Int. Cl.[3] ..... F21V 33/00

[52] U.S. Cl. ..... 362/96; 362/231; 362/252; 362/276

[58] Field of Search ..... 362/96, 231, 252, 276

[56] References Cited

U.S. PATENT DOCUMENTS 3,387,782 6/1968 Mizuno ..... 362/96

4,088,880 5/1978 Walsh ..... 362/96

*Primary Examiner*—Stephen J. Lechert, Jr.

*Attorney, Agent, or Firm*—Christie, Parker & Hale

[57] ABSTRACT

An ornamental water fountain is artificially illuminated by separate sets of differently colored lamps illuminated by a color blending system that responds to variations in musical tones. In one embodiment, there are three sets of lamps in separate principal colors, namely, red, blue and green, and the intensity of light from each set of lamps is independently controlled during the playing of a musical number, producing a multitude of different colors reflected by the fountain in response to variations in the amplitude and frequency of the musical tones. The color blending system operates in response to an input voltage representative of musical tones produced over a wide range of audio frequencies from a phonograph, tape player, radio receiver, or the like. The input voltage is separately coupled to low pass, band pass and high pass filters for producing separate frequency band signals representative of the content, i.e., combined amplitude and frequency, of the musical tones produced within low, intermediate and high frequency ranges, respectively. The three frequency band signals are fed to separate phase control circuits for independently adjusting power supplied to the different sets of lamps, thereby adjusting the intensity of the lamps in proportion to the content of sound produced within each frequency range.

10 Claims, 4 Drawing Figures

ARTIFICIAL ILLUMINATION OF ORNAMENTAL WATER FOUNTAINS WITH COLOR BLENDING IN RESPONSE TO MUSICAL TONE VARIATIONS

CROSS-REFERENCE TO RELATED PATENTS AND INCORPORATION BY REFERENCE

The subject matter of this invention is related to U.S. Pat. Nos. 3,705,686, issued Dec. 12, 1972; 3,773,257, issued Nov. 20, 1973; and 3,814,317, issued June 4, 1974. These patents are owned by the assignee of this application and are incorporated herein by this reference.

FIELD OF THE INVENTION

This invention relates to ornamental water fountains, and more particularly to a system for artificially illuminating the water display pattern of an ornamental water fountain with a lighting system in which lamps of different colors are illuminated in response to the variations in the amplitude and frequency of musical tones produced by an accompanying musical number.

BACKGROUND OF THE INVENTION

Ornamental water fountains contain a variety of nozzles capable of producing a multitude of imaginative and aesthetically pleasing liquid display patterns. Such ornamental water fountains are used outdoors such as at theaters, shopping malls, parks, museums, churches, golf courses, and the like, where their aesthetic qualities can be appreciated. Especially pleasing aesthetic lighting effects can be produced at night by illuminating water display patterns with lights of different colors.

The aesthetically pleasing effects of artificially illuminated ornamental water fountains can be enhanced by accompanying the lights with music. Entertainment programs also can be produced. It would be desirable to illuminate an ornamental water fountain with colors that change in response to corresponding variations in an accompanying musical number. However, the color variations of the lights should be effective visually, i.e., they should accurately represent the content of the accompanying musical number. It would also be desirable to illuminate an ornamental water display pattern in a multitude of different reflected colors, and blends of colors, rather than simply illuminating them with a few principal colors, one at a time.

The present invention provides a system for artificially illuminating ornamental water fountains so the water display patterns are illuminated in a multitude of different reflected colors and blends of colors in a visually effective scheme that corresponds to variations in the content of musical tones from an accompanying musical number.

SUMMARY OF THE INVENTION

Briefly, this invention comprises a color blending system for artificially illuminating an ornamental water fountain that produces a water display pattern. Separate sets of lamps illuminate the water display pattern, and each set of lamps has a different color combination. In one embodiment, the lamps are illuminated by a color synchronization system that responds to a system input signal representative of sound produced over a range of audio frequencies. The system input can be signals from an audio system, such as a tape player, phonograph, stereophonic receiver, or the like. A frequency filtering circuit responds to the system input signal for producing a plurality of frequency band signals each being representative of the content of sound produced within a different audio frequency range. The content of the sound can be a composite of the amplitude ard frequency variations of the sound within each frequency range. The intensity of light produced by each set of lamps is varied in response to the magnitude of a corresponding frequency band signal.

In one embodiment, the magnitude of the frequency band signals varies in proportion to the amplitude of the sound within each frequency range. In addition, the magnitude of the frequency band signals varies in relation to frequency of the sound within each frequency range. Each frequency band signal is coupled to a separate power control network for controlling power to each set of lamps in proportion to the magnitude of each frequency band signal. This adjusts the intensity of light from each set of lamps in proportion to the loudness and frequency variations of sound within each frequency range, and produces color blending that provides a visually effective representation of the accompanying musical number.

DRAWINGS

The above-mentioned and other features of this invention are more fully set forth in the following detailed description of presently preferred embodiments of the invention, the description being presented with reference to the accompanying drawings, in which.

DETAILED DESCRIPTION

Figure 1:
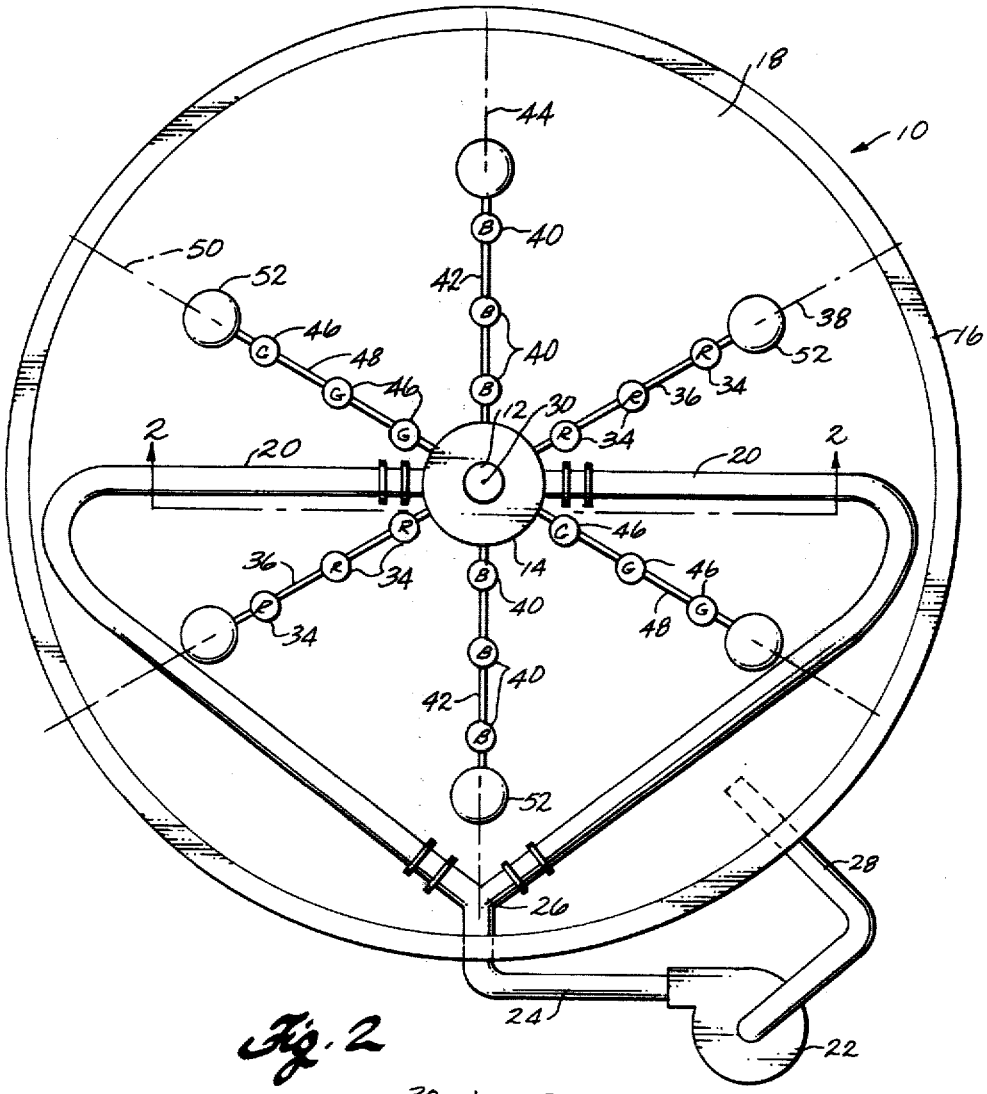
FIG. 1 is a semi-schematic plan view illustrating an artificially illuminated ornamental water fountain according to principles of this invention.
Figure 2:
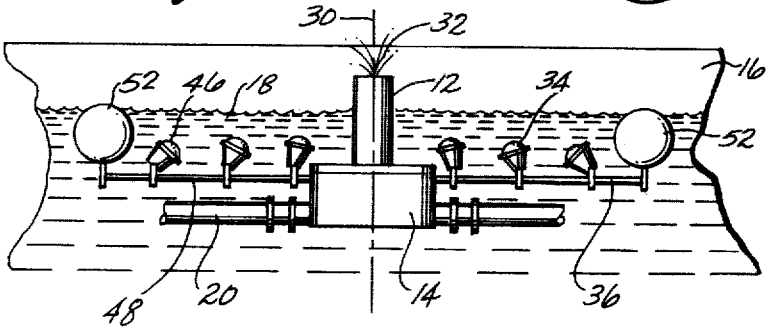
FIG. 2 is a fragmentary, semi-schematic side elevation view taken on line 2—2 of FIG. 1.

FIGS. 1 and 2 illustrate an artificially illuminated ornamental water fountain assembly 10 having an upright water display nozzle 12 carried on a base housing 14 located generally in the central region of a bowl structure 16. A quantity of water provides a fountain pool 18 in the bowl. The fountain assembly is located below the surface of the pool, with the exception of the upper portion of the nozzle which extends above the water surface.

A water supply conduit 20 is connected to the housing for supplying water to the interior of the housing from a suitable source of water under pressure, such as a pump 22. Two or more water supply conduits may extend from the housing to a pump discharge duct 24 via a suitable Y or plural arm fluid flow fitting 26. A duct 28 is connected from the pool water 18 to the suction port of the pump.

The water display nozzle 12 is disposed coaxially of the housing and extends along a vertical axis 30 of symmetry of the housing. Water is supplied to the interior of the housing via the water supply conduits 20, and water entering the housing can be distributed uniformly through the interior of the housing to provide water of substantially uniform flow characteristics from the housing through an output opening of the housing into the base of the fountain. This produces a characteristic water display pattern 32 forced upwardly from the nozzle along and about its upright axis of symmetry. The nozzle can be a variety of nozzle structures for providing ornamental water display patterns; but for the purpose of this invention, best results, in terms of effective illumination, are produced with a nozzle of a type that produces an unaerated water display pattern. The presence of fuzz or minute droplets in the display pattern can detract from the aesthetic properties of the pattern when the pattern is artificially illuminated, as at night. Fuzz or minute droplets can produce an essentially white or faintly colored display pattern when the pattern is illuminated by colored lighting. This problem can be avoided by using nozzles that produce unaerated water streams which are crystal clear. A crystal clear water display pattern clearly reflects the colors of light illuminating it. The nozzle 12 can be similar to a nozzle that produces such unaerated water display patterns, as is disclosed in U.S. Pat. No. 3,773,257, which is incorporated by reference. Further, different arrangements for supplying water to the housing 14, as well as the housing structure itself, can be used. Such a water supply system and housing structure can be similar to the arrangement disclosed in U.S. Pat. Nos. 3,705,686 and 3,814,317, which are incorporated by reference.

A plurality of lamps are mounted on a plurality of rigid lamp support arms extending radially outwardly from the housing in cantilever fashion. A first set of lamps 34 is mounted on a first set of support arms 36 secured to the housing and extending along a first transverse axis 38 that intersects the upright axis of symmetry of the fountain. There are a pair of such lamp support arms 36 extending radially outward from diametrically opposite sides of the fountain. The first set of lamps are preferably uniformly spaced apart along each lamp support arm. Preferably, there are one or more such lamps on each side of the fountain, and in the illustrated embodiment, there are three such lamps on each lamp support arm, i.e., three lamps on each side of the fountain.

A second set of lamps 40 is mounted to a second set of lamp support arms 42 extending along a second transverse axis 44 that intersects the upright axis of symmetry of the fountain. There is a pair of the second lamp support arms extending radially outwardly from diametrically opposite sides of the fountain, and the second axis on which the second set of lamps is aligned is at an angle relative to the first axis, so that the second set of lamps is angularly spaced apart from the first set of lamps. Since the axes on which the first and second lamps are aligned are straight, the first and second lamps are spaced apart by uniform angles on opposite sides of the fountain. The second set of lamps is uniformly spaced apart from one another along each second lamp support arm.

A third set of lamps 46 is mounted to a third set of lamp support arms 48 extending along a third transverse axis 50 that intersects the axis of symmetry of the fountain. There is a pair of the third lamp support arms extending radially outwardly from diametrically opposite sides of the fountain, and the third axis on which the third set of lamps is aligned extends at an angle relative to the first and second axes, so that the third set of lamps is angularly spaced apart from the first and second sets of lamps. Preferably, the third set of lamps extends at an angle approximately mid-way between the axes of the first and second sets of lamps so that the first, second and third sets of lamps are approximately symmetrically aligned around the axis of symmetry of the fountain. The third set of lamps is uniformly spaced apart from one another along each lamp support arm.

The axes of the three sets of lamps are preferably in a common substantially horizontal plane, and therefore are normal to the axis of symmetry of the fountain.

The apparatus for securing each lamp to its respective support arm and the appropriate angle of declination of each lamp on its support arm can be provided by the arrangement described in more detail in U.S. Pat. No. 3,814,317.

The outer ends of the lamp support assembly can be supported above the pool floor by adjustable feet, not shown, or other rigid support means; or they can be supported by a floating fountain assembly which includes floats 52 at the outer ends of the lamp support arms. Such a floating assembly is described in more detail in U.S. Pat. No. 3,814,317.

The three sets of lamps are in three different color combinations, preferably in three different principal colors, with the lamps in each set all being the same color. In the illustrated embodiment, lamps in the first set are red, the lamps in the second set are blue, and the lamps in the third set are green. This arrangement produces superior color blending when reflected by the water discharge pattern. Alternatively, lamps of different colors can be used on each side of the fountain, as long as substantially the same color combinations are present on opposite sides of the fountain. Thus, lamps of the same first color combination are aligned on a common first axis on diametrically opposite sides of the fountain; lamps of a different second color combination are aligned on another common second axis at an angle to the first axis and on diametrically opposite sides of the fountain; and lamps of different third color combination are aligned on another third axis at an angle to the first and second axes and are aligned on diametrically opposite sides of the fountain. It is preferred to provide the three sets of lamps in the principal colors as shown, although more sets of different color combinations can be used.

In use, the water display pattern is illuminated in a multitude of reflected colors and blends colors by simultaneously directing light at the display pattern from the three sets of lamps. Thus, red, blue and green light is directed at the display pattern from diametrically opposite sides of the pattern, but from different angles. The light from each set of colors is directed at approximately the same region within the display pattern and mixes to produce desired color reflections and blends of colors. This arrangement produces brightly illuminated reflections of the incident colors and blends of the incident colors without any appreciable light cancelling when the different colors are mixed. The water display pattern can be illuminated in a multitude of different colors by separately varying the intensity of light from each set of lamps. Such a light intensity variation adjusts the proportionate amount of each color in the color blend, and can produce an essentially infinite number of reflected colors and blends of colors.

Figure 3:
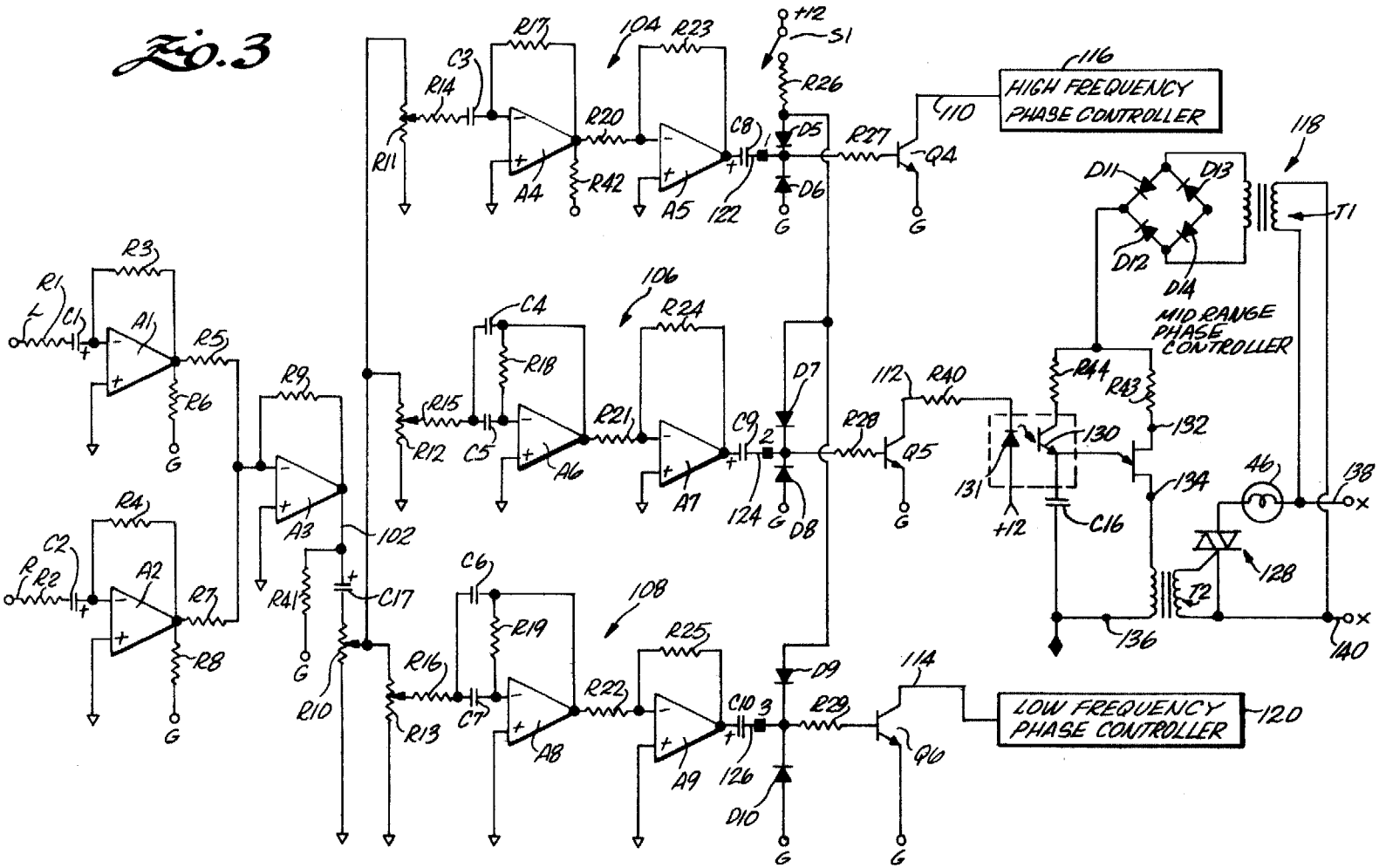
FIG. 3 is a schematic electrical diagram illustrating a system for controlling light intensity in response to variations in musical tones.

FIG. 3 illustrates one embodiment of a system for varying the light intensity produced by the red, green and blue lamps to produce color blending in response to variations in musical tones. Although musical tones are described, it should be understood that other means for generating audio signals over a wide range of audio frequencies can be used for influencing the intensity of light from each set of lamps, although it is preferred that the audio signal be in the form of musical tones.

In the system illustrated in FIG. 3, the light intensity of the lamps in each group is adjustable independently of the lamps in the other groups. The lamps in each group are connected in parallel so that all lamps in each group have essentially the same intensity as the light intensity is being adjusted. Each set of lamps is associated with a different frequency range of the musical tones being produced, and the content of sound within each frequency range is used to provide control over the intensity of the lamps associated with that particular frequency range. In the illustrated circuit, the red lamps are associated with the low frequency components of the musical sound, the green lamps are associated with an intermediate frequency range or mid-range component of the musical sound, and the blue lamps are associated with high frequency components of the musical sound. Thus, as the content of sound within the low frequency range increases, the intensity of the red lamps increases; as the content of musical sound within the high frequency range decreases, the intensity of the red lamps correspondingly decreases, and so on. This arrangement of colors versus frequency ranges is used for example only, since other combinations of colors and frequency ranges can be used without departing from the scope of the invention. The term "content" of the musical sound is described below.

Generally speaking, the color blending system of FIG. 3 respond to left and right system input signals L and R from the left and right channels of an audio amplifier. These input signals are buffered by first and second amplifiers A1 and A2, respectively. The system input signals can be the output from a stereophonic amplifier of a tape, phonograph, or radio receiver system playing a musical number. The left and right system input signals are summed by a summing amplifier A3 to form a composite output signal 102 representative of the sound produced over a range of audio frequencies, in this instance approximately 40 to 20,000 Hz. The composite, output signal is simultaneously applied to three filters, namely, a high pass filter 104, a band pass filter 106 and a low pass filter 108. The high pass filter includes amplifiers A4 and A5 for amplifying signals within a range of relatively high audio frequencies. The band pass filter includes amplifiers A6 and A7 for amplifying signals within a relatively intermediate range of audio frequencies. The low pass filter includes amplifiers A8 and A9 for amplifying signals within a relatively low range of audio frequencies.

The high pass, band pass and low pass filters produce output signals 110, 112 and 114 representative of the content of musical sound within the high, intermediate and low frequency ranges, respectively. The output signals from the high pass, band pass and low pass filters are coupled to separate identical lamp intensity controls circuits 116, 118 and 120, respectively, also referred to as high frequency, mid-range, and low frequency phase controllers. The phase controllers are coupled to respective sets of the lamps for illuminating the water display pattern of the fountain. In the illustrated embodiment, the phase controllers 116, 118 and 120 are coupled to the sets of blue, green and red lamps, respectively. Each phase controller generally comprises a control circuit for controlling the amount of electrical energy or power supplied to the lamps as a function of the content of the output signals from the respective filters. The amount of power supplied to the lamps controls the illumination characteristics, as described below.

To generally describe operation of the color blending system, it should be appreciated that a musical work can be converted to electrical signals by means of microphones in a live performance, or by means of stereophonic amplification equipment in the case of prerecorded works. These electrical signals provide the left and right channel system input signals L and R and are used to energize respective sets of colored lamps via the phase controllers. For example, high frequency sound, produced by brass instruments, is amplified and passed by the high pass filter 104, the output of which energizes the high frequency phase controller 116, thereby controlling illumination of the lamps coupled to that phase controller. Low frequency sound produced, for example, by bass instruments, is amplified and passed by the low pass filter, which provides an output that controls illumination of the lamps coupled to the low frequency phase controller 120. Sound in the intermediate frequency range is passed by the band pass filter which produces an output that controls illumination of the lamps coupled to the mid-range phase controller.

Coupling the output of each filter to respective phase controllers provides color blending of the light from the different sets of lamps, as described above, and such color blending is synchronized with the content of the accompanying music. The color blending relies on the content of the output signals from the filter circuits, and such content is characterized by both frequency and amplitude components of the musical sound in each frequency range.

Referring again to FIG. 3, the left channel portion of a system input signal is amplified, as previously discussed, by the amplifier A1. An amplifier circuit for the amplifier A1 includes a series-connected resistor R1 and a capacitor C1 coupled to the inverting input of the amplifier A1. A feedback resistor R3 is coupled between the output and the inverting input of the amplifier A1. The non-inverting input of the amplifier A1 is coupled to ground. The amplifier A1, as well as the amplifiers to be discussed, can be any one of a number of commercially available high gain differential amplifiers, such as National Semiconductor's LM324.

The right channel portion of the system input signal is amplified by the amplifier A2. An amplifier circuit of the amplifier A2 includes a series-connected resistor R2 and a capacitor C2 coupled to the inverting input of amplifier A2. A feedback resistor R4 is coupled between the output and the inverting input of the amplifier A2. The non-inverting input of amplifier A2 is coupled to ground. Separate resistors R6 and R8 are coupled to the outputs of amplifiers A1 and A2, respectively, for providing proper impedance loading for the amplifiers. The amplifiers A1 and A2 provide buffering for the left and right system input signals for preventing crossover between the signals of each channel.

The left and right channel output signals from the amplifiers A1 and A2 are mixed, i.e., added, in mixing the amplifier A3. The output of the amplifier A1 is coupled to the inverting input of mixing amplifier A3 through a series-connected resistor R5, and the output of the amplifier A2 is coupled to the inverting input of the mixing amplifier A3 through a series-connected resistor R7. A feedback resistor R9 is coupled between the output and the inverting input of the mixing amplifier A3. The non-inverting input of the mixing amplifier A3 is coupled to ground. The resistance values of the resistors R5, R7 and R9 are selected such that the mixing amplifier A3 provides gain in addition to mixing the left and right channel output signals from the amplifiers A1 and A2. Preferably, the gain is set at 1.5. A resistor R41 is coupled to the output of the mixing amplifier A3 to provide proper impedance loading for the mixing amplifier.

The output of the mixing amplifier A3 is coupled to a master gain potentiometer R10 through a series capacitor C17. The capacitor C17 provides DC isolation between the output of the mixing amplifier A3 and the potentiometer R10. The potentiometer R10 provides a master gain function for simultaneously adjusting the gain of the high pass, band pass and low pass filters 104, 106 and 108, respectively.

The high pass filter includes a potentiometer R11 coupled between the "wiper arm" of the master gain potentiometer R10 and ground. The "wiper arm" of potentiometer R11 is coupled to the inverting input of an amplifier A4 through a series-connected resistor R14 and capacitor C3. A feedback resistor R17 is coupled between the output and the inverting input of the amplifier A4. The potentiometer R11 provides sensitivity control for the high pass filter for adjusting of the gain and bandwidth of the filter. A resistor R42 is coupled between the output of amplifier A4 and ground for providing proper impedance loading for the amplifier A4.

The output of the amplifier A4 is coupled to the inverting input of an amplifier A5 through a series-connected resistor R20. The amplifier A5 provides buffering and amplification for the output of the amplifier A4. A feed-back resistor R23 is coupled between the output and the inverting input of the amplifier A5. The non-inverting input of the amplifier A5 is coupled to ground. The output of the amplifier A5 is coupled through a series-connected DC isolation capacitor C8 to the high frequency phase controller 10.

The gain of the high pass filter is directly proportional to the frequency of the signal passed by the filter. The magnitude of the filter output is also directly proportional to the magnitude of the portion of the filter input signal (from the potentiometer R10) within the frequency range passed by the filter.

The circuit description for the band pass and low pass filters is omitted since they are similar in design to the high pass filter, except for the frequency range-determining capacitors C4, C5 (band pass filter) and C6, C7 (low pass filter) and the gain-affecting resistors R24 (band pass filter) and R25 (low pass filter).

The magnitude of the output from the band pass filter is directly proportional to the magnitude of the portion of the filter input signal within the frequency range passed by the filter. In addition, the gain of the band pass filter is frequency-dependent. The gain rises in direct proportion to frequency passed by the filter and levels off at about the middle of the frequency range and the gain then progressively attenuates toward the end of the frequency range passed by the filter.

Similarly, the magnitude of the output from the low pass filter is directly proportional to the magnitude of the portion of the filter input signal within the low frequency range passed by the filter; and the gain of the filter rises in direct proportion to frequency and levels off at about the middle of the frequency range passed by the filter, and the gain then progressively attenuates toward the end of the frequency range passed by the filter.

Thus, the band pass filter produces an output signal 122 that represents a composite of the amplitude and frequency of sound produced within the high audio frequency range passed by the high pass filter. The composite signal is fundamentally directly proportional to the amplitude of sound produced within the high frequency range. That is, the louder the sound within the high frequency range, the greater the output signal from the high pass filter. Superimposed on this fundamental signal is a frequency-dependent component having a magnitude directly proportional to the frequency of the sound within the high frequency range.

The band pass filter produces an output signal 124 that represents a composite of the amplitude and frequency of sound produced within the intermediate audio frequency range passed by the band pass filter. The composite signal is fundamentally directly proportional to the amplitude of sound produced within the intermediate frequency range. Superimposed on the fundamental signal is a frequency-dependent component having a magnitude that rises in direct proportion to the frequency of sound within a beginning portion of the frequency range and levels off near the middle of the frequency range and then decreases in proportion to the frequency of sound within the later portion of the range.

The low pass filter produces an output signal 126 that represents a composite of amplitude and frequency of sound produced within the low frequency range passed by the low pass filter, and this composite signal varies with amplitude and frequency in a manner similar to the output from the band pass filter.

In the illustrated embodiment, the high pass filter passes frequencies from 900 Hz to beyond the audio range, the band pass filter passes frequencies in a range from 100 to 1100 Hz, and the low pass filter passes frequencies in a range from 40 to 150 Hz.

The phase controllers 116, 118 and 120 for the high pass, band pass and low pass filters are identical, so only one phase controller, i.e., the mid-range phase controller 118, is shown in the circuit diagram of FIG. 3. The phase controller is a phase control circuit for controlling the phase angle at which a Traic 128 (trademark of General Electric Co. for a gate-controlled full-wave a.c. silicon switch) begins conducting for providing power for illuminating the lamps 46 coupled to the mid-range phase controller. More specifically, the output 122 of the band pass filter is coupled to the base electrode of an amplifying transistor Q5 through a series-connected resistor R28. The emitter of transistor Q5 is coupled to ground, and the collector of transistor Q5 is coupled to an optoisolator 130. The transistor Q5 may be a conventional commercially available NPN transistor type no. 2N4921 manufactured by a number of transistor manufacturers. The optoisolator is preferably General Electric Model No. H11C1. The optoisolator 130 may be analogized to an NPN transistor having a light-emitting diode (LED) 131 that replaces the base electrode of a conventional bi-polar transistor. The cathode of the light-emitting diode is coupled to a positive voltage source, preferably 12 volts d.c., and the anode of the light-emitting diode is coupled to the collector of the transistor Q5 through a resistor R40. The emitter of the optoisolator 130 is coupled to the gate of a unijunction transistor Q7 and to a capacitor C16. The collector of the optoisolator 130 is connected through a series resistor R44 to a full-wave bridge rectifier comprising diodes D11, D12, D13, D14 and a secondary winding of a transformer T1. A base 132 of the unijunction transistor Q7 is coupled through a series resistor R43 to the full-wave bridge rectifier, and the other base 134 of the unijunction transistor Q7 is coupled to the primary winding of a trigger transformer T2. The capacitor C16 and a primary winding terminal 136 of the trigger transformer T2 are coupled to the full-wave bridge rectifier.

The lamps 46 and the Triac 128 are coupled in a series-circuit arrangement with electrical power lines 138 and 140. The electrical power lines may be from conventional, 120 volt, 60 cycles a.c. power. Although the lamps 46 are shown as a single lamp, the lamps 46 can be paralleled between the power line 138 and the Triac 128. The gate electrode of the Triac is coupled to the secondary winding of the trigger transformer T2. The secondary winding of the trigger transformer T2 is coupled to the electrical power line 140. The primary winding of the transformer T1 is also coupled to the electrical power lines 138 and 140. The full-wave bridge rectifier enables control of the Triac during each half cycle of the electrical power line signal.

The full-wave bridge rectifier provides an output voltage that serves as a voltage source for energizing the optoisolater 130 and the unijunction transistor Q7. The output voltage of the full-wave bridge rectifier is preferably about 12 volts d.c., that is electrically isolated from the 120-volt electrical power line.

Operation of the phase controller is as follows. The output signal 125 from the band pass filter is amplified by the transistor Q5, thereby causing current to pass through the LED 131. In response to the light emitted by the LED, the optoisolator 130 begins to conduct current. The amount of current conducted is proportional to the intensity of the light emitted from the LED 131. As the optoisolator conducts current, the voltage at the emitter rises, thereby raising the potential of the gate electrode of the unijunction transistor Q7. At such time that the gate potential exceeds the threshold voltage of the unijunction transistor Q7, the unijunction transistor begins conducting, thereby applying the full-wave rectifier bridge voltage to the primary of the trigger transformer T2. The voltage-induced current through the primary of the trigger transformer T2 causes a voltage pulse to appear on the secondary winding. The voltage pulse triggers the Triac 128 into conduction, thereby forming a closed circuit between the electrical power lines 138 and 140 and the lamps 46. The time at which the Triac 128 begins conducting during each half-cycle controls the portion of the half-cycle signal from the power line that is applied to the lamps. Thus, the amount of illumination provided by the lamps is controlled by the phase at which the Triac 128 begins conducting. For example, when the content of a stereophonic signal is higher than previously existing, the respective signal at the filter output is correspondingly higher, causing higher current to flow in the LED 131. The higher current in the LED causes an earlier conduction of the unijunction transistor Q7, correspondingly causing an earlier phase at which the Triac is triggered during its half-cycle. This causes the electrical power line signal to be applied to the lamps for a greater portion of each half-cycle of the electrical power line signal. The greater the amount of power line signal applied to the lamps, the greater the intensity of illumination from the lamps. At every zero crossover of the electrical power line signal, the unijunction transistor Q7 and the Triac are momentarily rendered non-conductive. The foregoing triggering sequence is repeated for each half-cycle following the zero crossover of the electrical power line signal.

Thus, as an accompanying musical number is played, the voltage signals representing muscial tone variations in each frequency range are fed to corresponding phase controllers. The phase controllers illuminate each set of lamps in relation to the presence of sounds within each frequency range. The intensity of light from each set of lamps is increased in direct proportion to the amplitude of loudness of the sound in each frequency range. In addition, the intensity of light corresponding to each frequency range is varied in relation to frequency changes of sound in each range. That is, an increase in frequency of musical tones in the high frequency range causes a corresponding proportional increase in intensity of light produced by the sets of blue lamps. An increase in the frequency of musical tones over the intermediate frequency range causes a progressive increase, followed by a levelling off, followed by a progressive decrease in intensity of light from the sets of green lamps. Similarly, an increase in the frequency of musical tones over the low frequency range causes progressive increase, followed by a levelling off, followed by a progressive decrease in the intensity of light from the sets of red lamps.

In addition, the phase controllers respond immediately to time span variations in musical tones. That is, the lamps are illuminated for a length of time in proportion to the duration of corresponding musical tones. For example, separate notes played by a trumpet in the high frequency range produce corresponding bursts of color from the sets of blue lamps.

As a result of the color blending system, a visually effective synchronization of light changes to musical variations is produced. Musical tones in each frequency range can vary in amplitude, frequency and time duration, and corresponding changes in light intensity from corresponding lamps are produced to simulate each of these variations in musical tones.

Testing of all the lamps independent of filter output is provided by separate test circuits that each receive current through a resistor R26 when a switch S1 is closed. The high pass filter test circuit includes diodes D5 and D6, the mid-range test circuit includes diodes D7 and D8 and the low pass test circuit includes diodes D9 and D10. A power supply provides a d.c. voltage of preferably 12 volts. Upon closing the switch S1, a d.c. voltage is applied at the output of each filter, thereby causing the phase controller to render the corresponding lamps conductive. In this manner, both the phase controller and the lamps can be checked for their operability.

Figure 4:
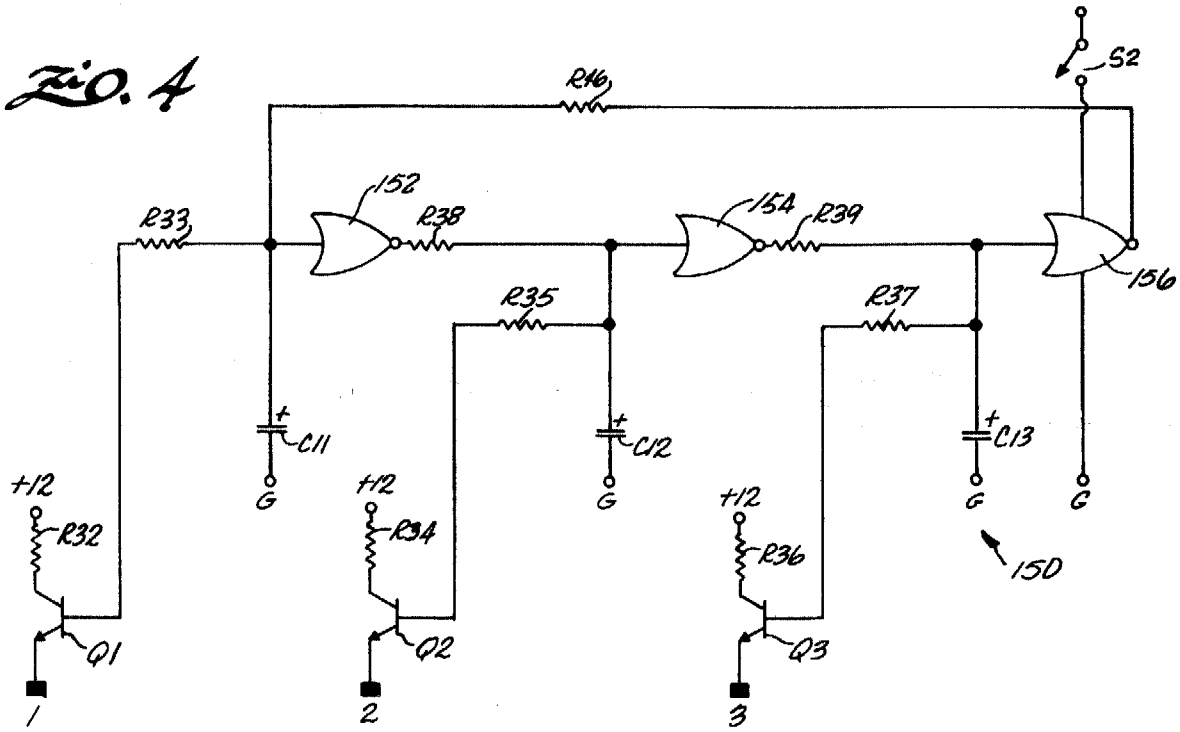
FIG. 4 is a schematic electrical diagram illustrating a system for controlling light intensity independently of accompanying musical tones.

FIG. 4 illustrates a circuit for providing illumination of the lamps in the absence of left and right system input signals. A three-phase oscillator 150 produces a three-phase signal for alternately energizing each of the phase controllers. The oscillator is in the form of a ring counter having three series-connected NOR gates (RCA CMOS chips, Model No. DC4001 are satisifactory). The NOR gates 152, 154 and 156 are connected in a conventional ring counter arrangement for alternately energizing three respective drive transistors Q1, Q2 ard Q3. The emitters of transistors Q1, Q2 and Q3 are coupled to the inputs of the respective phase controllers. When any one of the transistors Q1, Q2 or Q3 is rendered conductive, the corresponding phase controller lamps are illuminated. A switch S2 couples the voltage output of a voltage supply, not shown, to the ring counter. Upon closing of the switch S2, the states of the NOR gates 152, 154 and 156 are randomly assumed until the oscillator commences oscillation. The NOR gates operate as logic blocks so that a logical "0" (representative of zero or negative voltage) on the input provides logical "1" (representative of the power supply voltage) on the output. Thus, logical "1" is equal to a voltage potential of 12 volts, and logical "0" is equivalent to ground potential. The outputs of the gates will sequentially change from a "1" to "0," alternately energizing and de-energizing the transistors Q1, Q2 and Q3 coupled to the outputs of the respective gates. More specifically, the base of transistor Q1 is coupled to the output of the NOR gate 156 through a series resistor R33. The output of NOR gate 156 is coupled to ground through a series capacitor C11. The base of the transistor Q2 is coupled to the output of the NOR gate 152 through a series resistor R35. The output of the NOR gate 152 is also coupled to ground through a series capacitor C12. Similarly, the base of the transistor Q3 is coupled to the output of the NOR gate 154 through a series resistor R37, and the output of the NOR gate 154 is coupled to ground through a series capacitor C13. The emitters of the transistors Q1, Q2 and Q3 are coupled to the input of the respective phase controllers. Series resistors R38, R39 and R40 are connected between the NOR gates 152, 154 and 156, respectively.

Upon the occurrence of a "1" at the output of the NOR gate 154, for example, the base of the transistor Q1 will rise in potential at a rate determined by the time constant formed by the resistor R46 and the series capacitor C11. At such time as the base voltage of the transistor Q1 exceeds its forward bias threshold value (typically 0.7 volts), the transistor Q1 is rendered conductive, thereby applying a 12-volt bias to the input of phase controller 10. A "1" at the output of NOR gate 154 causes a "0" to occur at the output of NOR gate 152. A "0" at the output of NOR gate 152 causes the transistor Q2 to become non-conductive, thereby turning off the lamps controlled by the respective phase controller. A "0" at the output of NOR gate 152 causes a "1" to appear at the output of NOR gate 154. The base of the transistor Q3 will rise in potential at a rate determined by the time constant formed by the resistor R39 and capacitor C13. At such time that the voltage on the base of the transistor Q3 exceeds its forward bias threshold voltage, the transistor Q3 will be rendered conductive, and the lamps coupled to the respective phase controller are illuminated. A "1" at the input of NOR gate 156 causes a "0" to appear at the output of the NOR gate 156, rendering the transistor Q1 non-conductive, and thereby turning off the lamps coupled to the respective phase controller. The frequency of oscillation of the ring counter, as previously described, is determined by the values of the RC (respective time constants formed by the resistor R46 and capacitor C11, the resistor R38 and capacitor C12, and the resistor R29 and capacitor C13. By opening the switch S2, oscillation of the ring counter stops.

Suggested circuit elements and values for the circuit elements of FIGS. 3 and 4 are as folows:

| CIRCUIT ELEMENT | VALUE |
|---|---|
| R1 | 47 |
| R2 | 47 |
| R3 | 330 |
| R4 | 330 |
| R5 | 100 |
| R6 | 6.8 |
| R7 | 100 |
| R8 | 6.8 |
| R9 | 15 |
| R10 | 10 |
| R11 | 10 |
| R12 | 10 |
| R13 | 10 |
| R14 | 15 |
| R15 | 15 |
| R16 | 15 |
| R17 | 100 |
| R18 | 100 |
| R19 | 100 |
| R20 | 33 |
| R21 | 33 |
| R22 | 33 |
| R23 | 100 |
| R24 | 47 |
| R25 | 39 |
| R26 | 33 |
| R27 | 2.2 |
| R28 | 2.2 |
| R29 | 2.2 |
| R32 | 68 |
| R33 | 1 |
| R34 | 68 |
| R35 | 1 |
| R36 | 68 |
| R37 | 1 |
| R38 | 1 |
| R39 | 1 |
| R40 | 1 |
| R41 | 470 |
| R42 | 6.8 |
| R43 | 470 |
| R44 | 2.2 |
| C1 | 1 |
| C2 | 1 |
| C3 | 4700 |
| C4 | .02 |
| C5 | .02 |
| C6 | .1 |
| C7 | .1 |
| C8 | 10 |
| C9 | 10 |
| C10 | 10 |
| C11 | 10 |
| C12 | 10 |
| C13 | 10 |
| C16 | .1 |
| C17 | 10 |

I claim:

1. A color blending system for artificially illuminated ornamental fountains comprising:

an ornamental fountain for producing a liquid display pattern;

separate sets of lamps for the liquid display pattern, each set of lamps being of a different color combination;

audio signal means for producing a system input signal representative of sound produced over a range of audio frequencies;

means responsive to the system input signal for producing a plurality of separate frequency band signals each representative of the content of sound produced within a corresponding different audio frequency range; and control means for controlling the intensity of light produced by each set of lamps in response to a corresponding frequency band signal.

2. Apparatus according to claim 1 in which each frequency band signal has a magnitude proportional to the amplitude of sound produced within said corresponding audio frequency range.

3. Apparatus according to claim 1 in which the magnitude of each frequency band signal also varies as a function of the frequency of sound produced within said corresponding audio frequency range.

4. Apparatus according to claim 3 in which the control means controls the intensity of light from each set of lamps in proportion to the magnitude of the corresponding frequency band signals.

5. Apparatus according to claim 1 in which there are at least three sets of such lamps; in which the means for producing the frequency band signals comprises high pass, band pass and low pass electrical filter means for producing output signals representative of sound produced within high, intermediate and low frequency ranges, respectively; and in which the output of each electrical filter means is coupled to a respective set of lamps.

6. Apparatus according to claim 1 in which the audio signal means produces two separate audio input signals; and including a mixing circuit responsive to both audio input signals for producing a composite system input signal representative of sound produced over said range of audio frequencies, said means for producing the frequency band signals being responsive to said composite system input signal.

7. Apparatus according to claim 3 in which the magnitude of such a frequency band signal varies in direct proportion to the frequency of sound within the corresponding audio frequency range.

8. A color blending system for artificially illuminated ornamental fountains comprising:

an ornamental fountain for producing a liquid display pattern;

first, second and third sets of lamps for illuminating the liquid display pattern, each set of lamps being of a different color combination;

audio signal means for producing a system input signal representative of sound produced over a range of audio frequencies;

low pass filter means responsive to the system input signal for producing a first frequency band signal having a composite magnitude proportional to the amplitude of sound produced within a low audio frequency range and variable as a function of the frequency of sound within the low frequency range;

band pass filter means responsive to the system input signal for producing a second frequency band signal having a composite magnitude proportional to the amplitude of sound produced within an intermediate audio frequency range and variable as a function of the frequency of sound within the intermediate frequency range;

high pass filter means responsive to the system input signal for producing a third frequency band signal having a composite magnitude proportional to the amplitude of sound produced within a high audio frequency range and variable as a function of the frequency of sound within the high frequency range;

first lamp control means for supplying power to the first set of lamps in proportion to the magnitude of the first frequency band signal for adjusting the intensity of light produced by the first set of lamps;

second lamp control means for supplying power to the second set of lamps in proportion to the magnitude of the second frequency band signal for adjusting the intensity of light produced by the second set of lamps; and third lamp control means for supplying power to the third set of lamps in proportion to the magnitude of the third frequency band signal for adjusting the intensity of light produced by the third set of lamps.

9. Apparatus according to claim 8 in which the audio signal means produces two separate audio input signals; and including a mixing circuit responsive to both audio input signals for producing said system input signal.

10. Apparatus according to claim 8 in which the magnitude of each frequency band signal is directly proportional to the frequency of sound within the corresponding frequency range.

* * * * *